US005287920A

United States Patent [19]

Terrell

[11] Patent Number: 5,287,920

[45] Date of Patent: Feb. 22, 1994

[54] LARGE HEAD DOWNHOLE CHEMICAL CUTTING TOOL

[76] Inventor: Donna K. Terrell, 1916 Christopher Dr., Ft. Worth, Tex. 76140

[21] Appl. No.: 899,429

[22] Filed: Jun. 16, 1992

[51] Int. Cl.[5] ..... E21B 29/02

[52] U.S. Cl. ..... 166/55; 166/63; 166/213; 166/212

[58] Field of Search ..... 166/55, 55.1, 55.2, 166/63, 213, 212, 298, 241.6

[56] References Cited

U.S. PATENT DOCUMENTS

| | | | |
|---|---|---|---|
| 2,874,783 | 2/1959 | Haines | 166/212 |
| 2,918,125 | 12/1959 | Sweetman | 166/35 |
| 3,026,939 | 3/1962 | Sweetman | 166/55.1 |
| 3,130,786 | 4/1964 | Brown et al. | 166/55 X |
| 3,661,205 | 5/1972 | Belorgey | 166/212 |
| 4,047,569 | 9/1977 | Tagirov et al. | 166/222 X |
| 4,125,161 | 11/1978 | Chammas | 166/297 |
| 4,345,646 | 8/1982 | Terrell | 166/55 |
| 4,415,029 | 11/1983 | Pratt et al. | 166/212 |
| 4,428,430 | 1/1984 | Terrell et al. . | |
| 4,494,601 | 1/1985 | Pratt et al. | 166/55 |
| 4,619,318 | 10/1986 | Terrell et al. | 166/55 |
| 4,819,729 | 4/1989 | Lafitte | 166/55 X |
| 4,971,146 | 11/1990 | Terrell | 166/55 |
| 5,097,905 | 3/1992 | Goodwin | 166/213 |

*Primary Examiner*—Hoang C. Dang

*Attorney, Agent, or Firm*—Hubbard, Thurman, Tucker & Harris

[57] ABSTRACT

A downhole chemical cutting tool for use in a well bore to cut large diameter conduits including an elongated tool body having a chemical section adapted to contain a chemical cutting agent and a cutting section adapted to receive the cutting agent from the chemical section. The cutting section has a plurality of externally upset cutting heads extending circumferentially outwardly from the cutting section and terminating in outer cutting surfaces. Each of the cutting heads has a plurality of cutting ports extending radially inwardly from the outer cutting surface and in fluid communication with an internal chamber within the cutting section. The tool further comprises expansible slip and bow spring means in the elongated tool body for centering and anchoring the tool during cutting. The cutting heads are of a configuration having an inner spoke section which has a central bore opening into the interior chamber of the cutting section and a disk section secured to the outer portion of the spoke section. The cutting ports are located in the disk section and extend into fluid communication with the central bore within the spoke section. The central bore of the spoke section contains an accumulation of permeable ignitor material. The spoke and disk portions of the cutting heads preferably are formed as separate components secured through threaded connections.

33 Claims, 8 Drawing Sheets

LARGE HEAD DOWNHOLE CHEMICAL CUTTING TOOL

TECHNICAL FIELD

This invention relates to the cutting of downhole tubular goods in well bores, and more particularly to chemical cutting tools for cutting unusually large pipes of different diameters.

BACKGROUND OF THE INVENTION

There are many circumstances in the oil industry where it is desirable to cut into or through downhole tubular goods within a well. For example, in the course of drilling a well, the drill pipe may become stuck at a downhole location. This may result from "keyseating" or as a result of cuttings which settle within the well around the lower portion of the drill string. In order to remove the drill string from the well, it may be necessary to sever the drill pipe at a location above the stuck point. Similarly, it is often necessary to carry out downhole cutting operations during the completion or operation or abandonment of oil or gas wells. For example, it is sometimes desirable to sever casing or tubing at a downhole location in order to make repairs or withdraw the tubular goods from a well which is being abandoned. In other circumstances, it is desirable to cut slots, grooves or perforations in downhole tubular goods. Thus, it is a common expedient to perforate the casing and surrounding cement sheath of a well in order to provide fluid access to a hydrocarbon bearing formation. Similarly, it is sometimes desirable to perforate tubing in the completion or recompletion of a well.

Chemical cutters can be used to significant advantage in the application of chemicals to cut, sever or perforate downhole tubular goods. For example, U.S. Pat. No. 2,918,125 to Sweetman discloses a downhole chemical cutter which employs cutting fluids that react violently with the object to be cut with the generation of extremely high temperatures sufficient to melt, cut or burn the object. In the Sweetman procedure, halogen fluorides are employed in jet streams impinging on the downhole pipe to sever or perforate the pipe. The attendant reaction is highly exothermic and the pipe is readily penetrated. Examples of chemical cutting agents disclosed in Sweetman are fluorine and the halogen fluorides including such compounds as chlorine trifluoride, chlorine monofluoride, bromine trifluoride, bromine pentafluoride, iodine pentafluoride and iodine heptafluoride. The cutting fluid is expelled from the tool through radial ports formed in the cylindrical wall of the tool in jet cutting streams. In Sweetman, the cutting ports extend radially from a central bore within the discharge head of the cutting tool which terminates in a reduced diameter bore which is open to the lower or front end of the cutting tool. The reduced diameter bore is internally threaded to receive a threaded plug which closes the lower end of the bore. A piston is slidably disposed in the central bore and is equipped with o-rings which bridge the cutting ports when the piston is in the uppermost position. The piston is driven downwardly during the cutting operation. Immediately above the cutting ports is an ignitor section which can include three bodies of steel wool of progressively increasing coarseness and decreasing density toward the discharge end of the ignitor section. The upper portion of the cutting tool is provided with anchoring assembly comprising a plurality of radially projecting bow springs which terminate in downwardly depending slips which are adapted to grip the interior surface of the tubular goods during the cutting operation. The bow spring and slip configurations function to anchor the tool in response to an upward pull applied to the cable supporting the tool.

As further disclosed in U.S. Pat. No. 4,619,318 to Terrell et al., objects may be perforated or in some instances, completely dissolved with no debris left in the well through the use of a downhole chemical cutter. As disclosed in this patent, the chemical cutting tool may be provided with a downwardly extended nozzle provided with a suitable stand-off sleeve. In addition to the halogen fluoride cutting agents as disclosed in the aforementioned patent to Sweetman, further cutting agents as disclosed in the Terrell et al., patent include nitrogen fluoride sources.

Other than the particular adaptation of a nozzle configuration as described in the aforementioned Terrell et al. patent, the normal practice in severing downhole tubular goods is to arrange the cutting ports in the cylindrical wall of the cutting head. This practice is followed in U.S. Pat. No. 4,125,161 to Chammas. Here, the cutting head is a cylindrical member provided with a plurality of discharge ports arranged radially about the outer diameter of the head through which the chemical cutting agent issues in a plane generally perpendicular to the vertical centerline of the head. The cutting ports are bridged with a piston provided with o-rings to prevent the entry of fluids through the ports similarly as with the aforementioned patent to Sweetman. A lower portion of the tool is provided with openings through which well fluid exerts hydrostatic pressure on the bottom of the piston, holding the piston in place before the tool is fired. The Chammas cutting tool incorporates an anchor sub having a plurality of wedges pivoted on an actuating piston near the upper end of the tool in which gas from a propellant charge displaces an actuating piston to cam the wedges outwardly against the tubing string or other object to be cut. The gas from the propellant charge is also employed to force the cutting chemical into contact with a pre-ignitor and thence downwardly through ports in the cutting head and outwardly into contact with the pipe to be severed.

Yet another chemical cutting tool is disclosed in U.S. Pat. No. 4,494,601 to Pratt et al. Here, a lower part of the cutting head structure is open to well fluid and a piston plug is interposed immediately above the cutting ports. The cutting ports may be closed to the exterior of the well by means of an internal sleeve positioned in the bore of the cutting head immediately in front of the piston. When the tool is fired, the fluid pressure developed sets the anchoring means and forces the piston forward, exposing the port to the cutting fluid flowing into the bore from the chemical section. The tool further comprises means in the cutting section in front of the port to receive the piston upon the application of fluid pressure in the tool to lock the piston in place at a location in front of the cutting port. The locking means may take the form of a reduced section in the cutting tool bore which is adapted to receive a portion of the piston in a swedged relationship.

A particularly effective anchoring system for a chemical cutting tool is disclosed in U.S. Pat. No. 4,971,146 to Terrell. In this tool, a chemical module assembly is located intermediate to a propellant assembly and a cutting head assembly. Gas pressure generated by the ignitor of a propellant charge is employed to rapidly move a slip array against a slip expander, during which time the cutting action takes place. After the release of fluid pressure, the slip assembly reliably releases the tool due to the large angle of engagement of the slip segments.

SUMMARY OF THE INVENTION

In accordance with the present invention there is provided a new chemical cutting tool which can be employed to cut downhole conduits of large diameters. The chemical cutting tool of the present invention incorporates cutting head assemblies and anchoring systems which are effective for use in large diameter conduits of about 8 inches to a foot or even substantially larger. In accordance with the present invention there is provided a downhole chemical cutting tool having an elongated tool body adapted to be inserted into a conduit such as a large tubing string or casing within a well and positioned at a downhole location in the conduit for effecting a cutting action of the conduit. The tool body comprises a chemical section adapted to contain a chemical cutting agent and a cutting section adapted to receive the cutting agent from the chemical section. The cutting section has a plurality of externally upset cutting heads. The cutting heads extend outwardly from the cutting section circumferentially spaced transverse axes to a point where they terminate in outer cutting surfaces having a desired effective diameter. Each of the cutting heads has a plurality of cutting ports extending radially inwardly from the outer cutting surface to a position where they are in fluid communication with the internal chamber within the cutting section. The tool further comprises expansible slip means in the elongated tool body for anchoring the tool within the conduit as cutting agent is dispelled from the cutting ports.

In a specific embodiment of the invention, the slip means located below the cutting heads and the tool further comprises centralizing means located above the cutting heads. Preferably, the cutting heads are removably secured to the cutting section through appropriate threaded connections.

A preferred form of the cutting heads involves a two-component system having an inner spoke section which has a central bore opening into the interior chamber of the cutting section and a disk section secured to the outer portion of the spoke section. The cutting ports are located in the disk section and extend into fluid communication with the central bore within the spoke section. Preferably, the central bore of the spoke section contains an accumulation of permeable ignitor material.

The spoke and disk portions of the cutting heads preferably are formed as separate components. The spoke section is threadedly secured to the cutting section and the disk section is, in turn, threadedly secured to the spoke section. The cutting ports extending through the disk sections terminate in an inner surface spaced from the outer surface of the spoke section in an arrangement which defines a plenum chamber for the cutting agent.

In a preferred embodiment of the invention in which the slip means are located in the head section immediately below the cutting heads, an actuating piston is slidably disposed in the tool body for movement between a first position in which the slip means is in a retracted mode and a second lower position in which the slip means is in an expanded mode. The actuating piston is biased by suitable biasing means such as a compression spring toward the upper position. The piston plug is slidably disposed within the interior chamber of the cutting section at a location between the cutting heads and the chemical section and preferably, immediately above the cutting heads. On the generation of pressure within the tool, the piston plug is forced downwardly to move the actuating piston downward to expand the slips. The piston plug preferably remains locked in the actuating piston at the conclusion of the cutting operation.

In a further aspect of the invention, the cutting tool comprises a centralizer means above the primary slip assembly and the cutting section and which includes a plurality of outwardly projecting bow spring arms. Preferably, the tool includes means for expanding the bow spring arms as the cutting agent is dispelled from the cutting ports. In a specific embodiment of this aspect of the invention, the bow spring arms are slidably secured to the elongated tool body with a first longitudinal position on the tool body and the other ends of the arms are slidably secured to the elongated tool body at a second longitudinally spaced position. This arrangement is effected by means of a sleeve which is slidably mounted on the tool body and to which the bow spring arms are secured. Upon the generation of pressure, the piston is displaced toward the first fixed position of the bow spring arms to effect expansion thereof.

DESCRIPTION OF THE PREFERRED EMBODIMENT

The present invention provides a chemical cutting tool which can be effectively used in cutting downhole tubular members of relatively large diameters. This is accomplished in the present invention through the use of a cutting head configuration which can be used in conjunction with slip means which are operable through a relatively wide distance to provide a suitable stand-off distance from the cutting head to the surface to be cut. The invention further holds a single tool to be used repeatedly in different conduits over a wide range of diameters through the use of two or more sets of externally upset cutting heads which can be interchanged with one another to accommodate casing strings or other conduits of different sizes. Further, the invention embodies a multi-component anchoring system which can be used to effectively stabilize a cutting tool having a relatively small external diameter within a conduit of a relatively large internal diameter. The centralizing system provides a means for generally centralizing the tool as it is run in the well and at the same time can be partially deployed to act as a guard to prevent damage to the cutting head. The cutting head configuration of the present invention further enables the use of localized accumulations of ignitor materials which effectively acts as a pre-ignitor for the cutting agent immediately before it is dispelled through the cutting ports and impinged against the interior surface of the conduit to be severed or otherwise cut.

For a further description of the present invention, reference will be made to the drawings with regard to which the invention will be described in detail.

Figure 1:
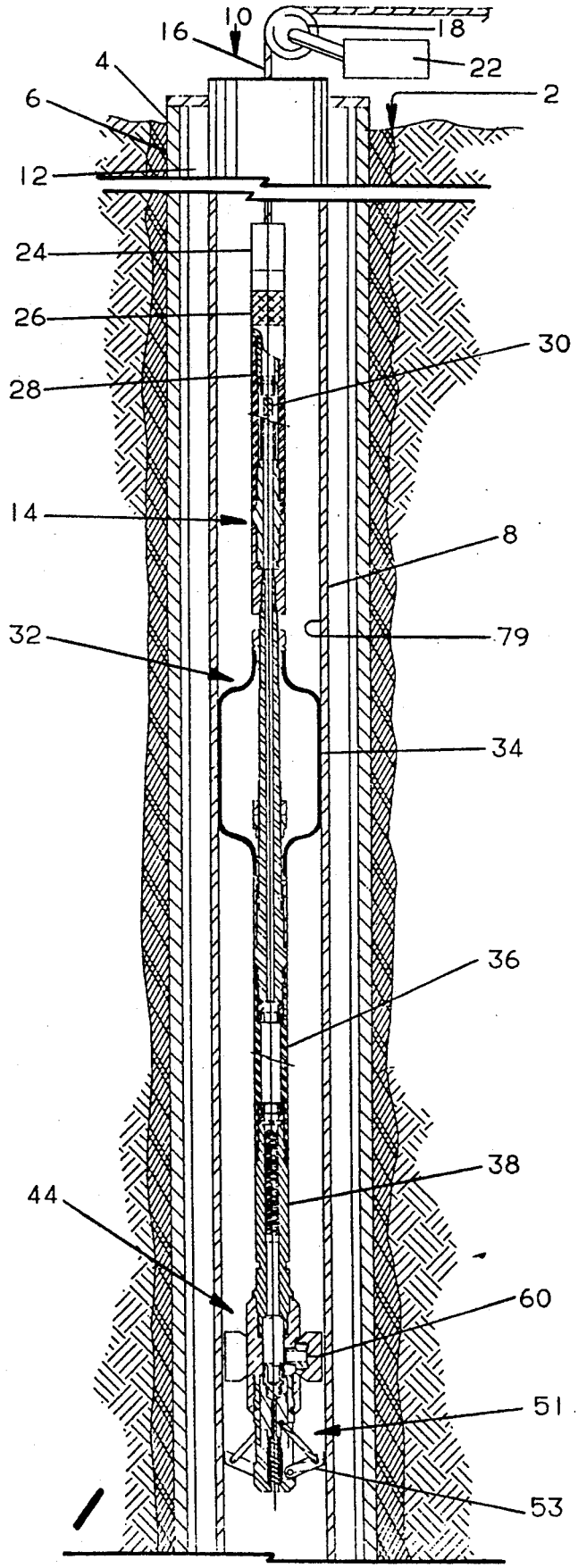
FIG. 1 is an illustration, partly in section, showing a downhole chemical cutter embodying the present invention located in a well.

As shown in FIG. 1 of the drawings, there is illustrated a chemical cutting tool embodying the present invention disposed within a well extending from the surface of the earth to a suitable subterranean location, e.g., an oil and/or gas producing formation (not shown). More particularly, and as is illustrated in FIG. 1, a well bore 2 is provided with a casing string 4 which is cemented in place by means of a surrounding cement sheath 6. A large diameter tubing string 8 is disposed in the well as illustrated and extends from the well head 10 to a suitable downhole location. The tubing string and/or the annular space 12 between the tubing and the casing may be filled with high pressure gas and/or a liquid such as oil or water. Alternatively, the tubing string 8 or the annulus 12 may be "empty", i.e., substantially at atmospheric pressure.

As further illustrated in FIG. 1, there is shown a chemical cutting tool 14 which is suspended from a cable (wireline) 16. The chemical cutter 14 is threadedly connected to cable 16 via the cable mounting device or cablehead 24. The cable 16 passes over suitable indicating means such as a measuring sheave 18 to a suitable support and pulley system 20. The measuring sheave 18 produces a depth signal which is applied to an indicator 22 which gives a readout of the depth at which the tool is located. It will, of course, be recognized that the well structure illustrated is exemplary only and that the cutting tool 14 can be employed in numerous other environments. For example, instead of a completed well, the tool can be employed in severing a drill pipe in either a cased or uncased well. In this case, the tubing string 8 shown would be replaced by a string of drill pipe.

The chemical cutter 14 is composed of five sections. At the upper end of the tool there is provided a fuse assembly 26 comprised of a fuse sub and an electrically activated fuse (not shown). Immediately below the fuse assembly 26 is a propellant section 28 which provides a source of high pressure gas. For example, the propellant section 28 may take the form of a chamber containing a propellant, such as gun powder pellets 30, which burns to produce the propellant gases.

Immediately below the propellant section 28 is a bow spring section 32 incorporating a plurality of multi-layered bow springs 34 that serve at least one and preferably two functions for the cutting tool incorporating the large composite heads of the present invention. Firstly, the bow spring arms 34 can be mechanically adjusted to provide a force generally normal to the vertical axis of the tool of sufficient magnitude to keep the large composite head assembly 44 described below, from dragging against the inside surface of the pipe 8 being cut. Therefore, the head assembly 44 is protected from sliding friction as the head assembly 44 is lowered down the well to lessen the likelihood of severe damage to the large composite head assembly 44. Secondly, as described below with respect to the preferred embodiment shown in FIG. 6, a vertically slidable piston in the tool applies an additional force to expand the multi-layered bow spring arms 34 during the cutting cycle. This results in "fine tuning" of the centralization function plus providing an anchoring force during the cutting cycle. This slidable piston is activated by the gas pressure generated during the cutting cycle. Where this embodiment is incorporated into the tool with extremely large composite head assemblies, the propellant section 28 may be supplemented with a second gas generating power unit (not shown) below the bow spring assembly 32.

A chemical module section 36 is located below the centralizer section 32. An optional ignitor sub 38 may be located immediately below the chemical module section 36. The composite head assembly 44 is in turn located below the ignitor sub 38 or the chemical section 36 in FIG. 1, as the case may be. The composite head assembly 44 comprises a head sub 50 with a plurality of externally upset cutting heads 60 extending outwardly from the head sub 50 and located about the periphery of the head sub. As described below, the cutting heads preferably are composite structures formed of disks 61 and individual threaded appenditures or "spokes" 62 which are connected to the head 50 like a center hub of a wheel. This composite construction will henceforth be referred to as a "wagon wheel" head based upon its general appearance. In the disks 61 are located a plurality of the cutting ports 46 where the chemical exits the composite head assembly 44 and is directed against the interior wall of the tubular member 8. Below the head assembly 44 is a slip assembly 51 comprising an array of slip elements 53 disposed peripherally of the tool. The slip assembly 51 centralizes the tool in the pipe and holds the tool stationary while the pipe is being cut.

The configuration of the cutting tool shown in FIG. 1 employing both the bow spring assembly 32 with an anchoring function and the slip assembly 51 is the preferred embodiment of the invention. However, one of these assemblies can be used in the chemical cutting tool without the presence of the other. Thus, the bow spring assembly 32 can be used to provide only a centralizing function (without the incorporation of a slidable piston to expand the bow springs as described below) or the bow spring assembly can be dispensed with all together. Similarly, in special applications, particularly where the cutting head is located in close proximity to the bow spring assembly, the slip assembly 53 need not be incorporated into the tool and the bow spring assembly relied upon to provide the sole anchoring function.

Figure 2:
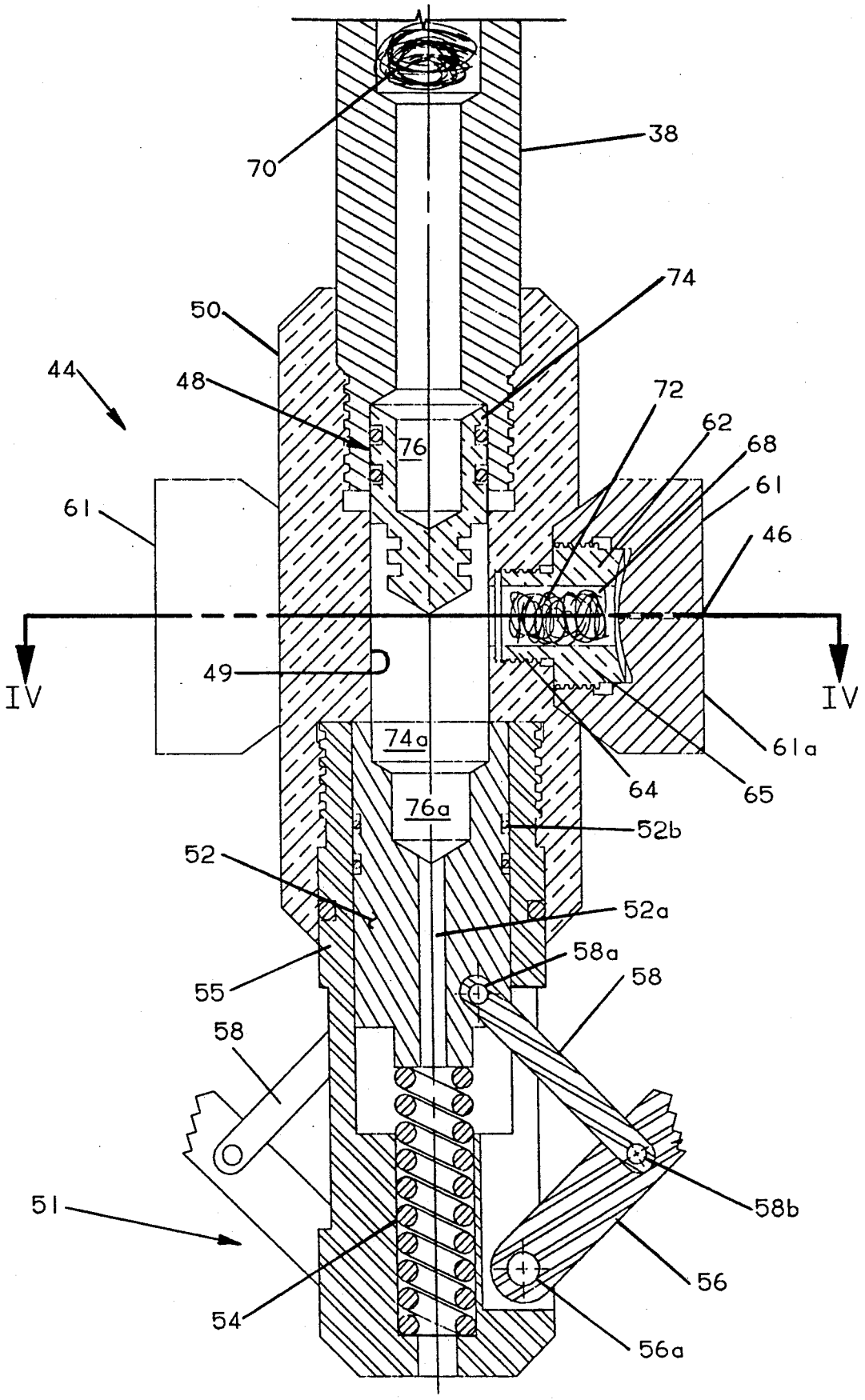
FIG. 2 is a side elevational view, partly in section, showing a preferred form of head assembly embodying the present invention.

Turning now to FIG. 2, there is shown a side elevation with parts in section of a cutting head assembly 44 and the lower portion of an optional ignitor sub 38 located immediately above the head assembly. As shown in FIG. 2, the head assembly includes a piston plug 48 slidably disposed within the central bore 49 of head 50. A slip support body 55 is threadedly secured to the bottom of the head mandrel 50 and thus supports the slip assembly with secondary piston 52 slidably disposed within the slip support 55 against the action of a compression spring 54. The secondary piston 52 is provided with a central bore **52*a* which provides for pressure equalization above and below the secondary piston and a plurality of o-ring seals 52*b* and 52*c*. The secondary piston 52 has an upper sectionalize bore 76*a* adapted to receive the primary piston 48** in a swedging relationship as described in greater detail hereinafter.

The slip assembly comprises a plurality of slip arms 56 and corresponding thrust arms 58. As shown in FIG. 2, slip arm 56 is pivotedly connected to plug 55 at bearing pin **56*a* and thrust arm 58 is connected to the secondary piston 52 at bearing pin 58*a* and to slip arm 56 at bearing pin 58*b***.

The preferred composite cutting head construction is illustrated in FIG. 2. As shown, the cutting head comprises a disk portion 61 which terminates in an outer cutting surface **61*a* externally upset from the head section by the desired distance to provide the appropriate stand-off distance from the surface to be cut. The disk portion 61 is threadedly secured to an inner spoke section 62 having an externally threaded reduced section 64 and an externally threaded enlarged section 65 to which the disk 61 is secured. The enlarged and reduced sections form a shoulder 66 which abuts against the conforming surface in the cutting head 50. The disk section 61 is threaded onto the exterior surface of the enlarged section 65 of spoke 62 and also is in an abutting relationship with the conforming surfaces on the cutting head 50. The spoke section has an enlarged interior bore 68 into which the radially extending cutting ports 46 extend. Preferably, the interior bore contains an ignitor material 72 in order to effect efficient pre-ignition of the cutting agent immediately before it exits cutting ports. However, special ignitor material 72 located in each spoke 62 could be substituted for ignitor hair 72 or used in conjunction with hair 72**.

As shown in FIG. 2, an optional ignitor sub 38 containing ignitor hair 70 may also be provided. One or both of these pre-ignitor materials can be used in the cutting tool depending upon the nature of the cut and the nature of the material to be cut. Where ignitor materials 70 and 72 are both used, they may be the same or different materials and each may, in turn, be formed of several components. By way of example, ignitor material 70 may be formed of steel wool or other like material which reacts with the chemical cutting agent at a more moderate temperature than the exothermic reaction occurring when the cutting agent reacts with the ignitor material 72 in the interior bore 68 of the cutting head spoke. For example, ignitor material 70 may be formed of steel wool and ignitor material 72 formed of two component mixture of steel wool containing a second component formed of stainless steel chips or shavings or the like.

The piston plug 48 preferably has an enlarged section 74 adapted to fit into a conforming enlarged bore **74*a* in secondary piston 52 and a reduced section 76 adapted to fit into a reduced counter sink bore 76*a* in the secondary piston 52. Preferably, the enlarged section 74 is bored out to provide a bore 78 as shown and the reduced section is provided with one or more grooves 80** as shown. This not only lightens the plug, it also accommodates the swedging action of the piston plug into the secondary piston as described below.

Figure 3:
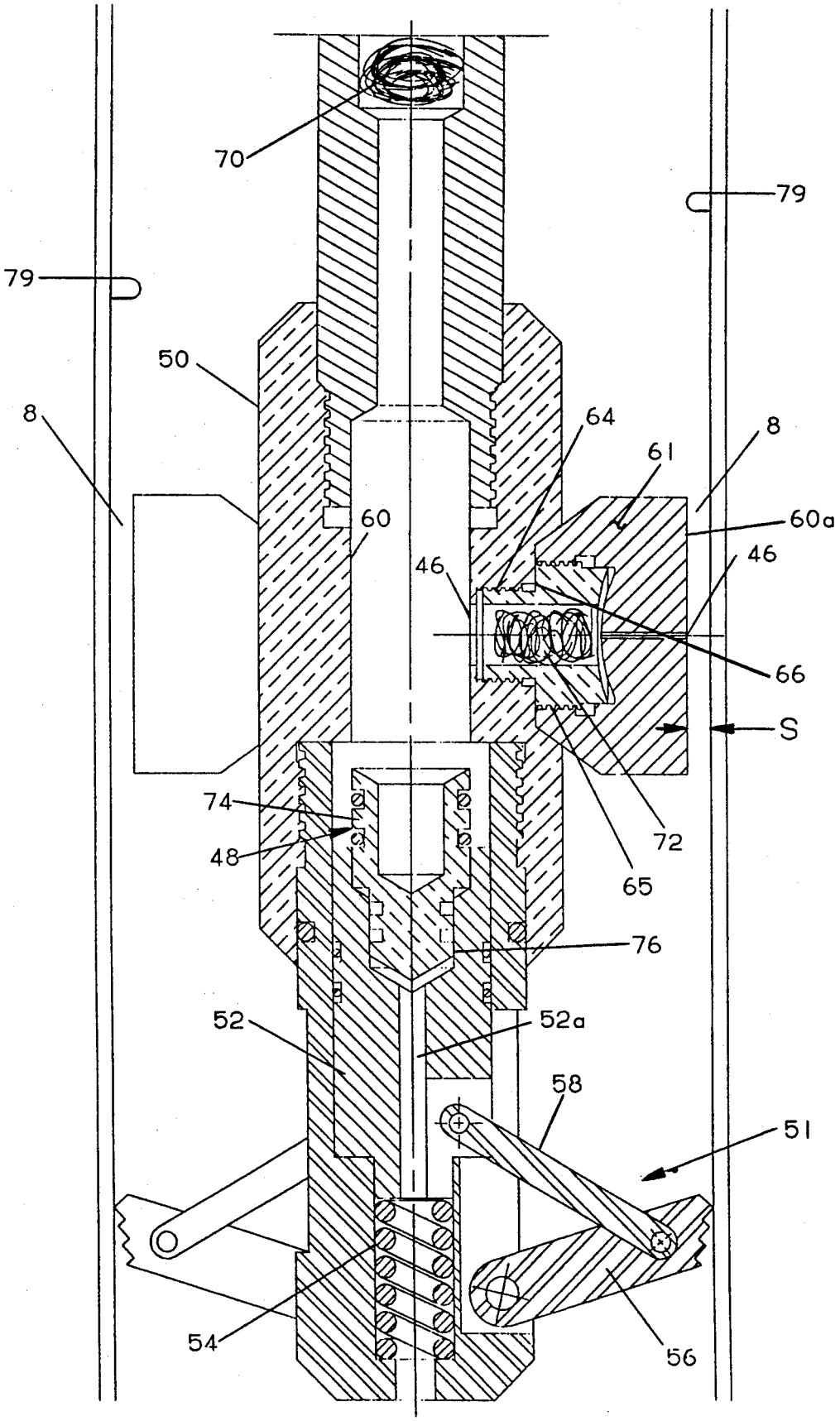
FIG. 3 is a side elevational view similar to FIG. 2, but showing the slip means in an expanded position as encountered during a cutting operation.

The operation of the chemical cutter tool 14 (FIG. 1) may be described briefly as follows. The tool is run into the well on the wireline 16 to the desired depth at which the cut is to be made. An electric signal is then sent via wireline 16 to the chemical cutter tool 14 where it sets off the fuse, in turn igniting the propellant charge within section 28. As the propellant 30 burns, a high pressure gas is generated and travels downward through the bow spring section 32 and forces the multilayered bow spring arms 34 outwardly in a manner described hereinafter. The bow spring arms 34 thus centralize and anchor the chemical cutter tool 14 in the tubing string 8. As the gas pressure further increases, seal diaphragms within the chemical module section 36 are ruptured and the chemical cutting agent is forced into the head section 44. Here, the chemical forces the piston plug 48 through the head 50 wedging the piston into the secondary piston 52 as shown in FIG. 3, described above. This ensures that the plug remains locked to the secondary piston at the conclusion of the cutting cycle. The secondary piston 52 travels downwardly compressing the return spring 54 and forcing the thrust arms 58, which are attached to the slip arm 56, outwardly. The slip arm 56 is then forced against the inside wall of the pipe 8, thereby centralizing and anchoring the tool stationary inside the pipe 8 while the pipe is being cut. When the piston plug 48 moves downwardly into the secondary piston 52, the piston plug 48 uncovers the exit holes in the head 50 and the chemical cutting agent is forced outwardly out of the head 50 into the spokes 62. Each spoke 62 preferably contains an accumulation of ignitor hair such as steel wool as described previously, which activates the halogen fluoride chemical, bringing it to a temperature that will dissolve the tubing 8. The halogen fluoride chemical is thus forced through the ignitor hair, which preignites the chemical. The gas pressure then forces the activated chemical into the disks and ultimately outwardly through the cutting ports 46. In a short period of time, normally a few seconds or less, the tubing 8 is severed, the pressure then equalizes itself inside and outside the chemical cutter tool 14 and the slip assembly 51 retracts due to the return action of the compression spring 54 at the bottom of the secondary piston 52. The chemical cutter tool 14 can be then withdrawn from the tubing string 8. For a further description of the general operating conditions and parameters employed in operation of a chemical cutter tool, reference may be made to the aforementioned U.S. Pat. Nos. 4,345,646 and 4,415,029, the entire disclosures of which are incorporated herein by reference.

As shown in FIG. 2, the slip arms, even when in the "retracted" position, extend radially outwardly of the tool body by a substantial distance. This configuration is preferred since the slip arms then act to at least partially shield the cutting disks 61 as the tool is lowered through the well. This arrangement thus reduces the likelihood that the cutting disks 61 will be damaged by debris within the well.

FIG. 3 is a side elevational view similar to FIG. 2, but showing the slip arms in the expanded position during firing of the tool. As shown in FIG. 3, the piston plug 48 has moved downwardly into the secondary piston 52, forcing the secondary piston downwardly to the position shown thus expanding the slips by action of the slip arms 58. Immediately after the cutting action is concluded, the pressure across the secondary piston will be more or less equalized and the compression spring 54 will force the piston upwardly to the position shown in FIG. 2. The bore sections 74*a* and 76*a* of the secondary piston 52 are of a slightly reduced diameter relative to their counterpart sections 74 and 76 in the piston plug. Thus, the piston plug remains wedged into a piston 52 in a manner somewhat similar to the corresponding function described in the aforementioned U.S. Pat. No. 4,494,601. By way of example, the piston 14 may be formed of a relatively malleable material such as copper with the upper enlarged section 74 having an external diameter of about 0.90 inches and the reduced lower section 76 having an external diameter of about 0.70 inch. The inner diameters of the counterpart bores in the secondary piston 52 may, in this example, be about 0.88 inch for bore 74*a* and 0.68 inch for bore 76*a*. As further shown in FIG. 3, the slip arms 56 centralize the tool to provide a desired stand-off distance, S, between the outer surface 61*a* of the disks and the inner surface 79 of the tubular member. The outer ends of the slip arms 56 are, in the deployed position, generally parallel to the pipe surface 79 as shown and may be curved slightly as viewed from the side.

Figure 4:
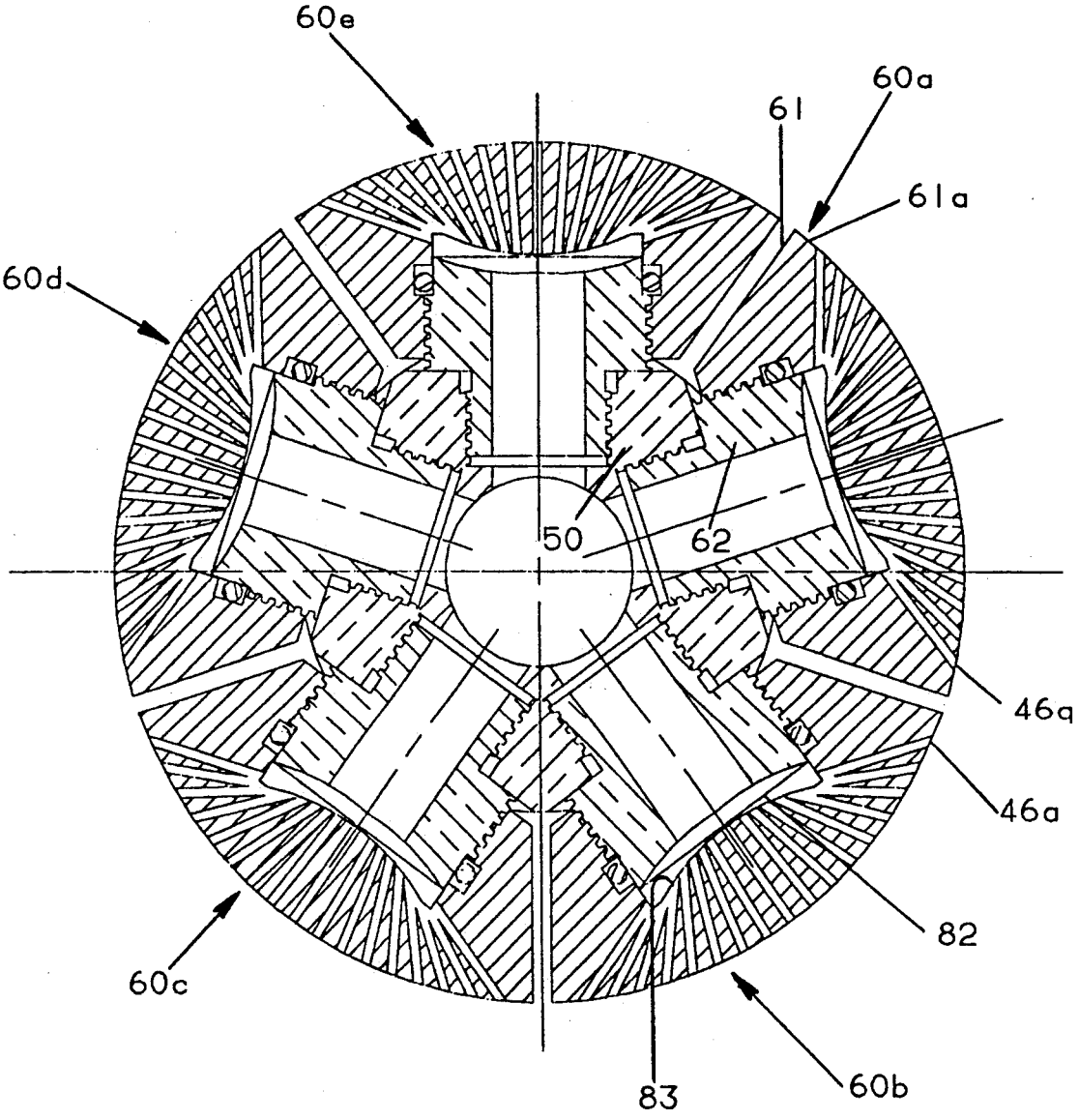
FIG. 4 is a sectional view taken along line 4—4 of FIG. 2, showing a preferred arrangement of multi-component cutting heads.

In one embodiment of the invention illustrated herein, the cutting head assembly carries five outwardly extending cutting heads. This arrangement is shown in FIG. 4, which is a sectional view taken through line 4—4 of FIG. 2 to show the five heads 60*a* through 60*e* arranged peripherally about the head section 50. As shown in FIG. 4 with reference to cutting heads 60*a* through 60*d*, the outer cutting surface 61*a* of each disk is arc-shaped, generally conforming with the interior surface of the tubular member to be cut, thus providing a generally uniform a desired stand-off distance s (FIG. 3) from one cutting port to the next. Each disk 61 is threadedly secured onto spoke member 62, as described previously. Each disk 61 has a plurality of cutting ports arranged radially so that cutting fluid issuing through the ports impinges upon a designated segment of the conduit being cut. As shown in FIG. 4, the cutting ports 46*a* through 46*q* terminate on the inner surface 83*a* of the disk 61 spaced from the outer surface of the corresponding spoke 62 in order to define a plenum chamber as indicated by reference numeral 82. This feature provides for a uniform distribution of chemical cutting agents through the respective ports 46*a* through 46*q* shown in FIG. 4. It is to be recognized that the cutting ports in the several disks are to be configured so that the entire surface of the tubular member is contacted by cutting agent. Thus, the axis extended of port 46*q* of the disk 61*a* should intersect the axis extended of port 46*a* of disk 60*b* at or before the interior surface of the tubular member to be cut in order to avoid "blank" surfaces, which are not effected by the cutting agent.

The cutting head assembly shown in FIGS. 2 through 4 is well suited for cutting intermediate to large diameter tubular goods in excess of 7 inches ranging up to about one foot in diameter. Several sets of externally upset cutting heads having the configuration shown in FIG. 4 can be used within this range. As will be recognized from the foregoing description, both the disk portions and the spoke sections can be radially increased or reduced to provide a desired stand-off condition when going from one set to another.

Figure 5:
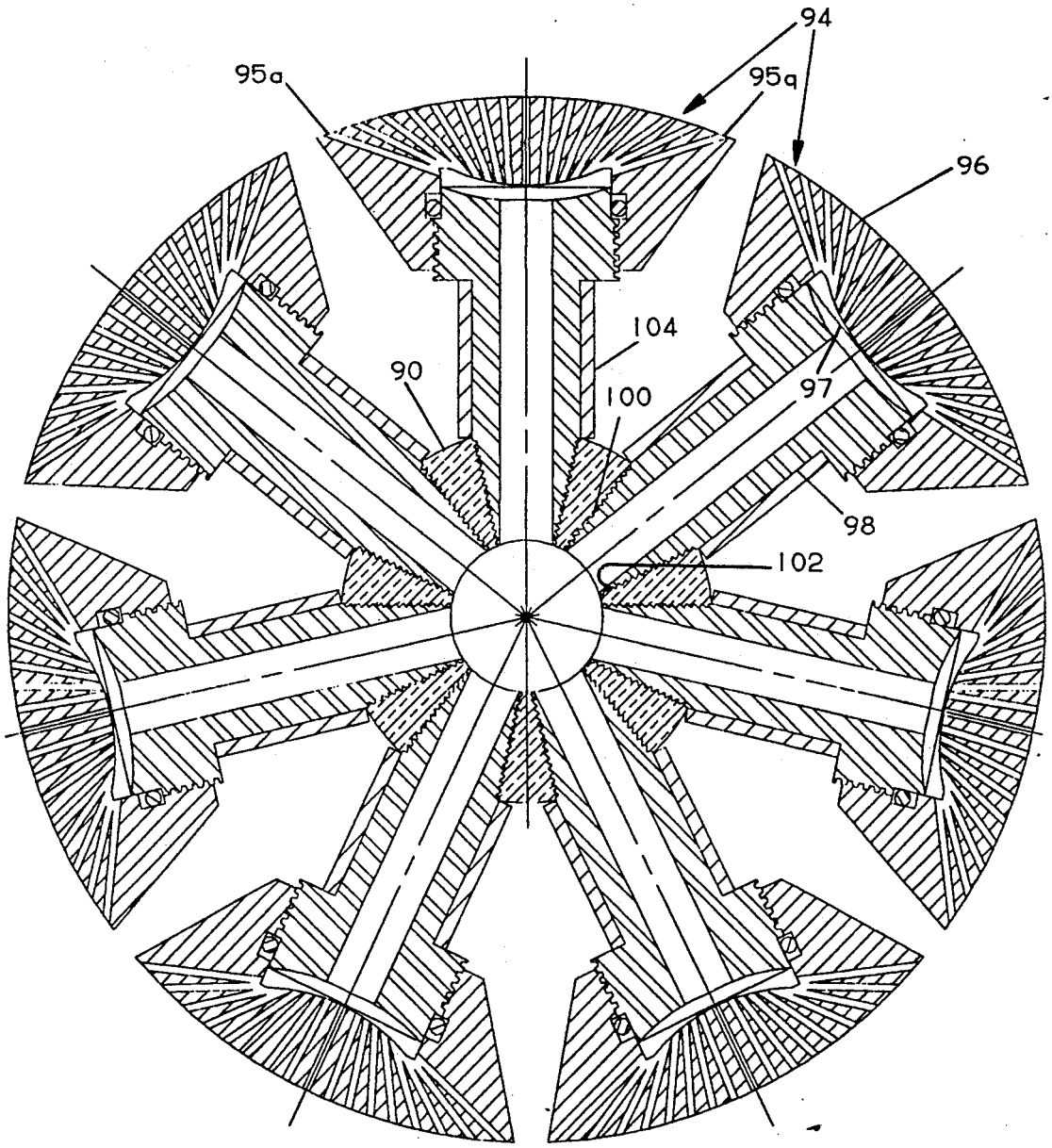
FIG. 5 is a sectional view similar to FIG. 4 but showing another arrangement of cutting heads.

FIG. 5 illustrates yet another embodiment of the invention which can be used in cutting unusually large diameter tubular goods ranging in size of up to several feet in diameter. FIG. 5 is a horizontal sectional view similar to FIG. 4, but showing spoke sections of substantially greater length than the spokes in the embodiment of FIG. 4.

In the embodiment of FIG. 5, there is provided a cutting head sub 90 (corresponding to sub 50 described earlier) which is provided with seven cutting disks 94, each composed of a disk section 96 and a spoke section 98. The disk sections 96 are very similar in configuration to the disk sections 61, described earlier except that the outer surface 96*a* has a larger radius of curvature to conform generally to the larger tubular goods. Each of the cutting disks have cutting ports 95*a* through 95*q* arranged similarly as described before and terminating in a plenum chamber 97 as described before. The spoke sections have enlarged externally threaded end portions which carry the cutting disks as described previously, but in this case, the reduced shank portions 98 are much longer in order to provide the desired stand-off distance from the outer cutting head surface to the surface to be cut. In addition, the inner ends of the spoke sections terminate in inwardly diverging threaded pin sections 100 which are threadedly secured into outwardly diverging box sections 102 of a conforming shape.

The spokes 98 may be formed of copper or other suitable materials similarly as the spokes 62 described earlier. However, in this case because of the relatively long length of spokes 98, it is preferred to provide the reduced diameter section which is threadedly inserted into the cutting head with an insulation sleeve 104. The insulation sleeves may be formed of any suitable material such as steel or a ceramic having a substantially lower heat conductivity than the material forming the spokes 98.

Figure 6:
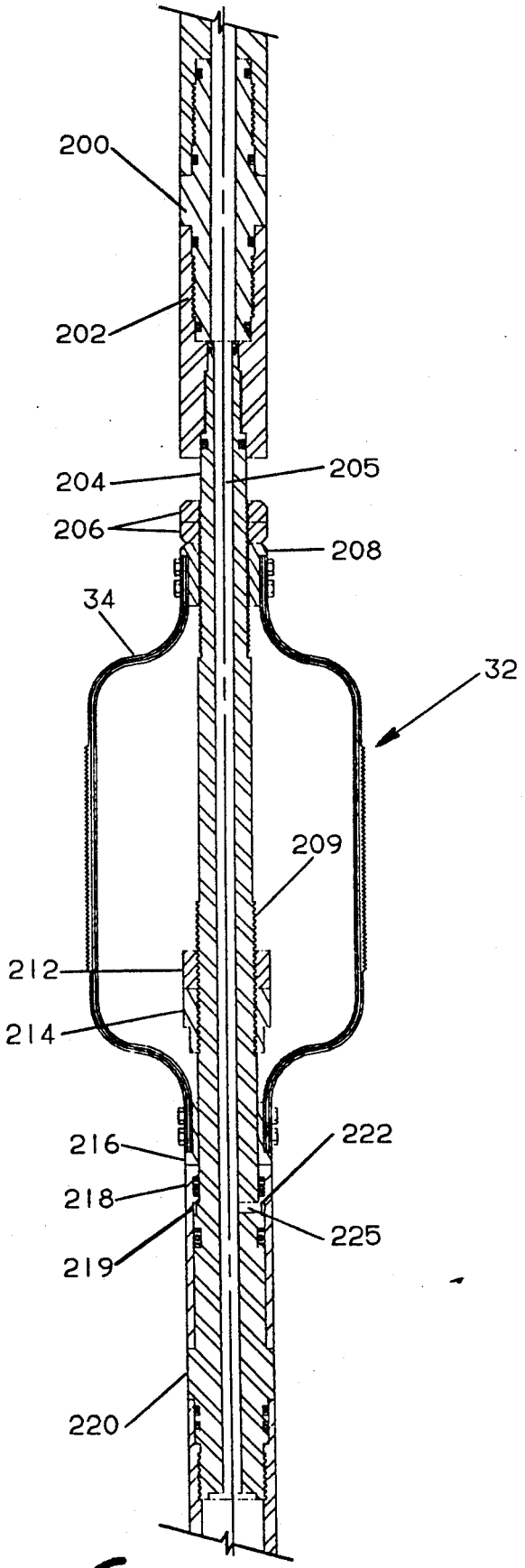
FIG. 6 is a side elevational view, partly in section, showing a preferred form of a bow spring slip assembly embodying the present invention.

Turning now to FIG. 6, there is shown the preferred form of the anchoring assembly 32. As shown in FIG. 6, the assembly 32 comprises a sub 202 connected to a connector sub 200 which, in turn, is connected to the propellant sub 28 (FIG. 1). Threadedly secured into sub 202 is an elongated mandrel 204 having a bore 205 extending longitudinally thereof. An intermediate portion of mandrel 204 is threaded externally at 207 to carry a pair of lock nuts 206. An adjustment sleeve 208 is slidably disposed on threaded section 207 and lock nuts 206 function to lock the sleeve 208 in the desired position. A lower intermediate portion of mandrel 204 has a second section of external threads 209, which serve to carry an adjustment sleeve 214 and a lock nut 212 for locking the sleeve 214 in place at a desired location along threads 209. A lower sleeve 216 is slidably disposed on the outer surface of sub 205. The three layered bow spring arms 34 of the bow spring assembly are bolted at their outer ends to sleeves 208 and sleeve 216 as shown. It will be recognized that as sleeves 208 and 216 move toward one another, the bow spring arms 34 will be expanded, the degree of expansion depending upon the distance between the two sleeves.

An annular piston 218 is slidably disposed on a polished portion of the outer surface of tool 204 and in the lower position shown in FIG. 6, abuts against an annular shoulder 220. The upper portion of piston 218 is internally upset to produce an active face 219. The reduced section of member 204 upon which the upper portion of piston 218 rides, provides an interior piston chamber 222 which is open through a port 225 to the bore 205. As can be seen from an examination of FIG. 6, when the tool is fired, the high pressure propellant gases enter the annular piston chamber 222 and act against the active face 219 of piston 218 to drive the piston and the abutting sleeve 216 upwardly, thus expanding the bow spring arms 34. Stop sleeve 214 serves as a limiting factor to prevent stressing of the bow spring arms to the point where they would be broken or permanently deformed. At the conclusion of the cutting cycle the spring action of the arms force the piston downwardly as the pressure within the tool drops off. As will be recognized, the retracted diameter of the bow spring sleeves can be regulated by moving adjustment sleeve 208 upward to retract them further or by moving it downwardly to expand them. Similarly, the maximum expansion of the bow spring arms during the cutting action can be adjusted by adjustment sleeve 214.

The multi-component head assembly of the present invention is particularly well suited to adaptations as necessary to meet special cutting jobs. For example, special cutting disks can be employed with cutting ports configured to cut extremely high temperature and difficult to cut tubular goods such as stainless steel and the like. In this case, the cutting ports can be configured in a plurality of planar conformations as described in U.S. patent application Ser. No. 07/899,632 entitled DOWNHOLE CHEMICAL CUTTING TOOL AND PROCESS, filed on even dated hereof by the same inventors herein.

In this embodiment of the invention, the cutting ports in the disks are arranged in a plurality of groups of conforming patterns. One group of cutting ports is arranged in a configuration conforming to the desired shape of the cut and define a first planar pattern. A second group of cutting ports conform generally to the first pattern and are in a canted relationship with respect to the second pattern. Preferably, at least some of the cutting ports in the first group are in a staggered relationship longitudinally along the tool body relative to at least some of the cutting ports in the second group.

In one configuration, the cutting ports in the disks are arranged such that when the disks are in place in the tool the ports extend circumferentially of the tool body to provide first and second planar patterns, generally normal to the major axis of the cutting tool. The planar patterns are in a converging relationship such that they intersect at a locus externally of the cutting disk surface. Another configuration is especially adapted to cut relatively large perforations in downhole tubular goods. Here, the cutting ports lie in first and second ringshaped configurations in an annular relationship with one another. The cutting ports within the inner ring configuration preferably are on different radii than the cutting ports in the outer ring to provide for an increased metal volume around the cutting ports.

Figure 7A:
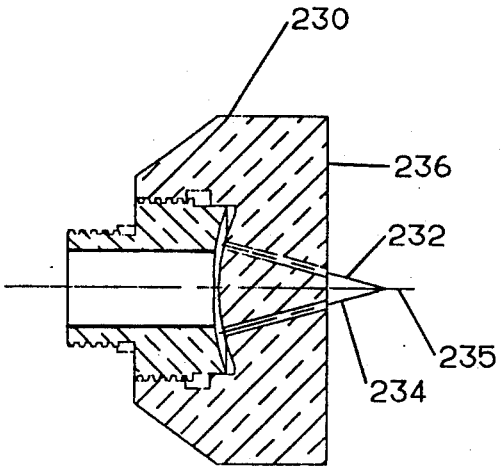
FIG. 7*a* is a side sectional view of a modified form of cutting head disk in which the cutting ports are arranged in a plurality of converging planes.
Figure 7B:
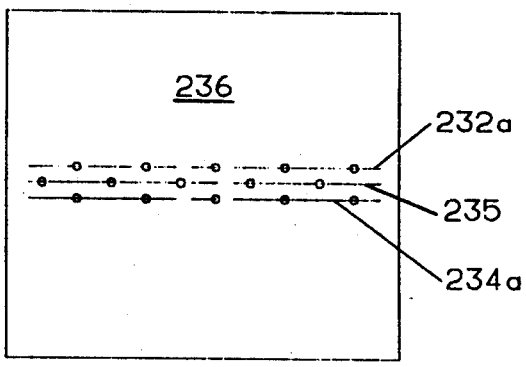
FIG. 7*b* is a front elevational view of the cutting face of the disk of FIG. 7*a*.

Turning first to FIGS. 7*a* and 7*b*, these figures show respectively a sectional view of a cutting disk 230 with the holes configured in three converging planar patterns and front elevational view of the disk showing the arrangement of holes in the outer cutting surface of the disk. As shown in FIGS. 7*a* and 7*b*, the cutting ports in disk head 230 are drilled in upper and lower converging frusto-conical planes 232 and 234 and intermediate plane 235, which is normal to the cutting face 236 of the disk. As shown in FIG. 7*b*, the three rows of holes, 232*a*, 234*a* and 235*a*, are staggered with respect to each of the holes in the next adjacent plane in order to provide substantial distance between adjacent holes for the purpose of strength of the head. As explained in greater detail in co-pending application Ser. No. 07/899,632, the angle of frusto-conical plane 232 and frusto-conical plane 234 is such that the two planes intersect with the intersection of plane 235. Preferably, the angles of the planes are such that a jet of cutting fluid issuing from ports in the three planes will meet at a desired distance of about ½ through the wall of the tubular member being cut. It will be recognized that head 230 shown in FIG. 7 is exemplary of only one of the heads and that the remaining heads will be configured similarly to provide, for example, a five head tool as in the case of the configuration shown in FIG. 4 or a seven head tool as in the case of a cutting assembly configuration as shown in FIG. 5.

Figure 8A:
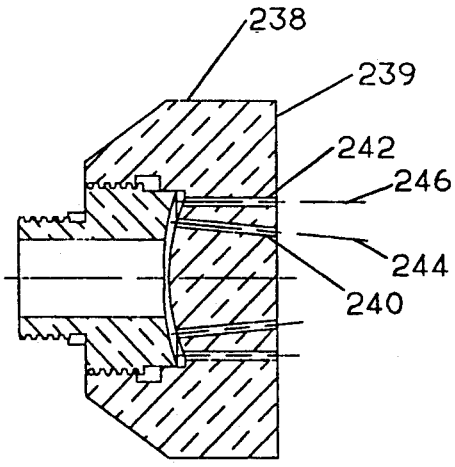
FIG. 8*a* is a side sectional view of a modified form of cutting head disk having an arrangement of cutting ports in accordance with another embodiment of the invention.
Figure 8B:
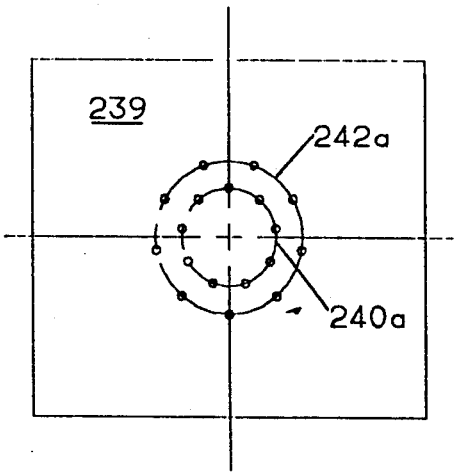
FIG. 8*b* is a front elevational view of the cutting face of the disk of FIG. 8*a*.

FIGS. 8*a* and 8*b* disclose an embodiment of the invention involving a cutting disk 238 in which the loci of cutting ports 240 and 242 formed in the cutting disk are circles 240*a* and 242*a*, respectively when viewed from a perpendicular plane with respect to the axis of the disk as indicated in FIG. 8*b*. As shown in FIG. 8*a*, the inner set of cutting ports 240 converge inwardly slightly to form a truncated cone 244. The outer set of ports 242 are parallel to form a cylindrical surface 246. The tool may be equipped with one or it may be equipped with a plurality of disks 238, depending upon the number of perforations to be cut in the tubular member. The arrangement shown in FIGS. 8*a* and 8*b* will tend to cut a perforation in the tubular goods in which the inner diameter of the perforation will be greater than the outer diameter.

Figure 9A:
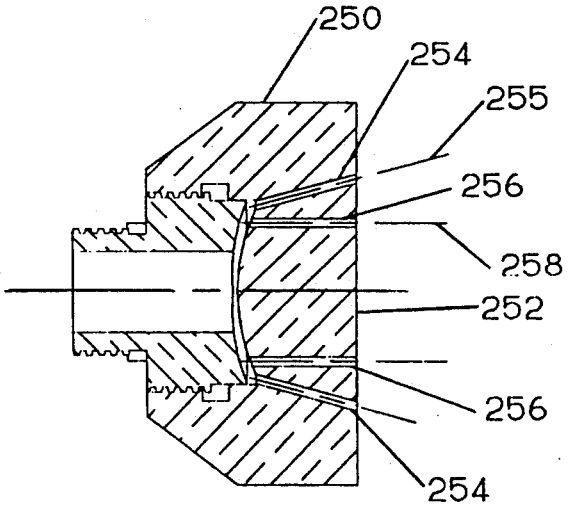
FIG. 9*a* is a side sectional view of a modified form of cutting head disk having an arrangement of cutting ports in accordance with another embodiment of the invention.
Figure 9B:
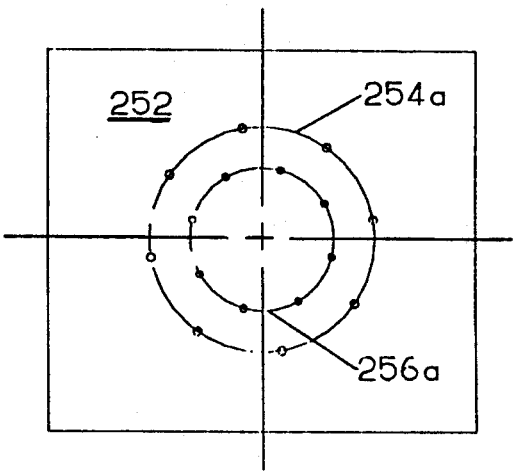
FIG. 9*b* is a front elevational view of the cutting face of the disk of FIG. 9*a*.

FIGS. 9*a* and 9*b* illustrate a cutting disk 250 having a cutting surface 252 incorporating yet another embodiment of the invention which can be used in lieu of the cutting disk shown in FIGS. 8*a* and 8*b* to cut a perforation in the tubular goods and having approximately equal inside and outside diameters. FIGS. 9*a* and 9*b* are similar in their views to FIGS. 8*a* and 8*b*. FIG. 9*a* is a sectional view through the head to show the arrangement of the cutting ports in which ports 254 lie in a conical surface 255 and ports 256 are parallel to form a cylindrical surface 258. The cutting ports 254 and 256 form concentric circles 255*a* and 256*a*, as viewed from a perpendicular plane normal to the axis of the cutting disk 250 as shown in FIG. 9*b*. Ports 254 form a truncated cone which diverges outwardly in contrast with the converging cone of FIGS. 8*a* and 8*b*. For a further description of the configurations of the cutting ports in the embodiment shown in FIGS. 7, 8 and 9, reference is made to the aforementioned application Ser. No. 07/899,632, the entire disclosure of which is incorporated herein by reference.

Having described specific embodiments of the present invention, it will be understood that modifications thereof may be suggested to those skilled in the art, and it is intended to cover all such modifications as fall within the scope of the appended claims.

I claim:

1. In a downhole chemical cutting tool having an elongated tool body adapted to be inserted into a conduit and positioned at a downhole location thereof for effecting a cutting action in said conduit, the combination comprising:

a) a chemical section in said elongated tool body adapted to contain a chemical cutting agent;

b) a cutting section in said elongated tool body adapted to receive said chemical cutting agent from said chemical section and having an interior chamber for the distribution of said chemical cutting agent;

c) a plurality of externally upset cutting heads extending outwardly from said cutting section along circumferentially spaced transverse axes, each of said cutting heads having an outer cutting surface;

d) each of said cutting heads having a plurality of cutting ports extending radially inward from the outer cutting surface thereof and in fluid communication with said internal chamber within said cutting section; and e) an expansible slip means in said elongated tool body for anchoring said tool body as said cutting agent is dispelled from said cutting ports;

2. The combination of claim 1, wherein said slip means is located below said externally upset cutting heads.

3. The combination of claim 2, further comprising centralizing means on said elongated tool body located above said externally upset cutting heads for centralizing said tool body.

4. The combination of claim 3, wherein said centralizing means is outwardly expansible.

5. The combination of claim 1, wherein said cutting heads are removeably secured to the cutting section of said elongated tool body.

6. The combination of claim 5, wherein said cutting heads are threadedly secured to the cutting section of said elongated tool body.

7. The combination of claim 1, wherein each of said cutting heads comprises an inner spoke section secured to the cutting section of said tool body and having a central bore therein opening into the interior chamber of said cutting section and further comprising a disk section having said outer cutting surface secured to said spoke section, said cutting ports being located in said disk section extending from the cutting surface to said central bore.

8. The combination of claim 7, wherein the central bores of said spoke sections have an accumulation of permeable ignitor material disposed therein whereby cutting agent being dispelled from said tool traverses said ignitor material prior to entering said cutting ports.

9. The combination of claim 8, wherein said ignitor material comprises a first metal in the form of an intermeshing filamentary structure and at least a second metal component formed of a second metal which is more corrosion resistant than said metal of said intermeshing filamentary structure.

10. The combination of claim 9, wherein said first component comprises iron and said second component comprises stainless steel.

11. The combination of claim 10, wherein the spoke and disk portions of said cutting heads are separate components in which the spoke section is threadedly secured to said cutting section and said disk section is threadedly secured to said spoke section.

12. The combination of claim 11, wherein each of said spoke sections comprise externally threaded reduced portion secured in said cutting section and an externally threaded enlarged portion forming a shoulder with said reduced portion and threadedly secured within said cutting disk.

13. The combination of claim 11, wherein the cutting ports in said disks terminate in an inner surface spaced from the outer surface of said spoke section to define a plenum chamber for said cutting agent.

14. The combination of claim 1, further comprising an actuating piston for said slip means slideably disposed in said tool body between an upper first position in which said slip means is in a retracted mode and a lower second position in which said slip means is in an expanded mode to anchor said tool body, return means for biasing said actuating piston to the upper first position and means for driving said actuating piston to said lower second position to expand said slip means.

15. The combination of claim 14, wherein said driving means comprises a piston plug slideably disposed in said interior chamber and normally located in said interior chamber between said cutting heads and said chemical section.

16. The combination of claim 14, wherein said slip means when in said retracted mode extend outwardly from said elongated tool body to at least partially shield said cutting heads from obstructions below said cutting tool.

17. The combination of claim 14, wherein said slip means comprise a plurality of slip arms pivotedly mounted on said elongated tool body at the lower ends thereof at circumferentially spaced locations on said tool body and further comprising opposed thrust arms pivotedly connected to said actuating piston and to said slip arms whereby when said actuating piston moves to said lower position, said thrust arms force said slip arms outwardly in a deployed position.

18. The combination of claim 1, wherein said externally upset cutting heads are releasably secured to said cutting section and further comprising a second plurality of externally upset cutting heads, said second plurality of cutting heads when in place in said cutting section extending outwardly from said cutting section by a distance different than the distance by which said first plurality of cutting heads extend outwardly from said cutting section.

19. The combination of claim 1, wherein said cutting ports in said upset cutting heads are formed in at least first and second groups arranged circumferentially of said elongated tool body, said first group defining a first planar pattern extending generally normal to the major axis of said tool body and said second group defining a second planar pattern generally conforming to said first pattern and in a converging relationship with said first pattern.

20. The combination of claim 19, wherein said first group of cutting ports defining said first planar pattern are in a downwardly converging relationship with respect to said second group of cutting ports defining said second planar pattern.

21. The combination of claim 20, wherein at least some of the cutting ports in said first group are in a staggered relationship longitudinally along said tool body relative to at least some of the cutting ports in said second group.

22. In a downhole chemical cutting tool having an elongated tool body adapted to be inserted into a conduit and positioned at a downhole location thereof for effecting a cutting action in said conduit, the combination comprising:

a) a chemical section in said elongated tool body adapted to contain a chemical cutting agent;

b) a cutting section in said elongated tool body adapted to receive said chemical cutting agent from said chemical section and having an interior chamber for the distribution of said chemical cutting agent;

c) a plurality of externally upset cutting heads extending outwardly from said cutting section along circumferentially spaced transverse axes, each of said cutting heads having an outer cutting surface;

d) each of said cutting heads having a plurality of cutting ports extending radially inward from the outer cutting surface thereof and in fluid communication with said internal chamber within said cutting section;

e) expansible slip means in said elongated tool body for anchoring said tool body as said cutting agent is dispelled from said cutting ports;

f) a pressure generating section in said tool body within which pressure is generated to actuate said expansible slip means and to displace cutting agent from said chemical section into said cutting section; and g) centralizer means located in said elongated tool body above said slip means and said cutting section and comprising a plurality of outwardly projecting bow spring arms to effect a centralizing action of said tool when inserted within a conduit.

23. The combination of claim 22, further comprising means for expanding said bow spring arms as said cutting agent is dispelled from said cutting ports.

24. The combination of claim 22, wherein said bow spring arms are adjustable inwardly and outwardly in a direction normal to the axis of said tool body to accommodate the insertion of said cutting tool into conduits of varying diameter.

25. The combination of claim 22, wherein said bow spring arms are spaced circumferentially around said elongated tool body and secured at the ends thereof to said tool body at first and second longitudinally spaced positions along said tool body.

26. The combination of claim 25, wherein said bow spring arms are secured to said tool body by means of an adjustment sleeve on said tool body adapted to expand and retract said bow spring arms.

27. The combinations of claim 26, wherein said adjustment sleeve is adjustably secured on said elongated tool body for longitudinal movement therealong to effect expansion and retraction of said bow spring arms.

28. The combination of claim 25, wherein said bow spring arms are fixedly secured to said elongated tool body at said first longitudinal position and slidably secured to said elongated tool body at the second position by means of a piston to which said bow spring arms are secured, said sleeve being slidably mounted on said elongated tool body.

29. The combination of claim 28, wherein said piston is displaced longitudinally along said tool body toward said first position in response to the generation of pressure within said pressure generation section.

30. In a downhole chemical cutting tool having an elongated tool body adapted to be inserted into a conduit and positioned at a downhole location thereof for effecting a cutting action in said conduit, the combination comprising:

a) a chemical section in said elongated tool body adapted to contain a chemical cutting agent;

b) a cutting section in said elongated tool body adapted to receive said chemical cutting agent from said chemical section and having an interior chamber for the distribution of said chemical cutting agent and at least one cutting port for the discharge of said cutting agent from said cutting section;

c) a pressure generating section in said tool body within which pressure is generated to displace cutting agent from said chemical section into said cutting section;

d) centralizer means located in said elongated tool body comprising a plurality of outwardly projecting expansible bow spring arms spaced circumferentially around said elongated tool body to effect a centralizing action of said tool when said tool is inserted within a conduit, said bow spring arms being fixably secured to said elongated tool body at a first longitudinal position and slidably secured to said elongated tool body at a second longitudinally spaced position by means of a piston to which bow spring arms are secured, said piston being slidably mounted on said elongated tool body; and e) means responsive to pressure from said pressure generating section for expanding said bow spring arms to anchor said tool as said cutting agent is dispelled from said cutting port.

31. The combination of claim 30, wherein said bow spring arms are secured to said tool body at said first position by means of an adjustment sleeve which is adjustably secured on said elongated tool body for longitudinal movement therealong to effect expansion and retraction of said bow spring arms.

32. The combination of claim 31, further comprising means threaded on the exterior of said tool body for adjustably limiting the movement of said adjustment sleeve.

33. In a downhole chemical cutting tool having an elongated tool body adapted to be inserted into a conduit and positioned at a downhole location thereof for effecting a cutting action in said conduit, the combination comprising:

a) a chemical section in said elongated tool body adapted to contain a chemical cutting agent;

b) a cutting section in said elongated tool body adapted to receive said chemical cutting agent from said chemical section and having an interior chamber for the distribution of said chemical cutting agent and at least one cutting port for the discharge of said cutting agent from said cutting section;

c) a pressure generating section in said tool body within which pressure is generated to displace cutting agent from said chemical section into said cutting section;

d) centralizer means located in said elongated tool body comprising a plurality of outwardly projecting expansible bow spring arms to effect a centralizing action of said tool when said tool is inserted within a conduit;

e) means responsive to pressure from said pressure generating section for expanding said bow spring arms to anchor said tool as said cutting agent is dispelled from said cutting port;

f) second anchoring means on said tool body spaced from said centralizer means and comprising expansible slips for anchoring said tool body at a second longitudinally spaced position in response to the generation of pressure within said pressure generating section.

* * * * *